US006519903B1

(12) United States Patent
Dirisamer et al.

(10) Patent No.: US 6,519,903 B1
(45) Date of Patent: Feb. 18, 2003

(54) DEVICE FOR FIXING PLATES, IN PARTICULAR GLASS PLATES

(75) Inventors: Wolfgang Dirisamer, Linz (AT); Roland Leopoldseder, St. Valentin (AT); Christian Eckelt, Steyr (AT); Albrecht Burmeister, Weissach im Tal (DE)

(73) Assignee: Saint-Gobain Glass France, Courbevoie (FR)

( * ) Notice: Subject to any disclaimer, the term of this patent is extended or adjusted under 35 U.S.C. 154(b) by 0 days.

(21) Appl. No.: 09/403,774

(22) PCT Filed: Mar. 4, 1999

(86) PCT No.: PCT/FR99/00487

§ 371 (c)(1),
(2), (4) Date: Feb. 1, 2000

(87) PCT Pub. No.: WO99/45217

PCT Pub. Date: Sep. 10, 1999

(30) Foreign Application Priority Data

Mar. 6, 1998 (DE) ..... 198 09 617

(51) Int. Cl.[7] ..... E04B 2/88

(52) U.S. Cl. ..... 52/235; 52/204.66; 52/506.05; 52/706; 52/711; 52/512

(58) Field of Search ..... 52/204.593, 204.66, 52/235, 506.05, 508, 509, 512, 706, 709, 711

(56) References Cited

U.S. PATENT DOCUMENTS 2,879,660 A * 3/1959 Reintjes ..... 52/409
4,060,951 A * 12/1977 Gere ..... 52/508
4,744,191 A * 5/1988 Fricker ..... 52/702
4,905,444 A * 3/1990 Semaan et al. ..... 52/710
5,265,396 A * 11/1993 Amimoto ..... 52/745.12
5,644,889 A * 7/1997 Getz ..... 52/713
6,098,364 A * 8/2000 Liu ..... 52/506.08

FOREIGN PATENT DOCUMENTS

| | | |
|---|---|---|
| DE | 1189696 | 3/1965 |
| DE | 2460879 | 6/1976 |
| EP | 0508840 | 10/1992 |
| EP | 0655542 | 5/1995 |
| FR | 2738271 | 3/1997 |
| GB | 2307491 | 5/1997 |

* cited by examiner

*Primary Examiner*—Carl D. Friedman
*Assistant Examiner*—Brian E. Glessner
(74) *Attorney, Agent, or Firm*—Oblon, Spivak, McClelland, Maier & Neustadt, P.C.

(57) ABSTRACT

An attachment device for panes of glass. The attachment device includes retainers arranged between each pane and a support structure. The retainers include structures to compensate for the dimensional differences, deformations and displacements between the pane and the support structure. Degrees of freedom of rotation of the structure include uni-axis pivot joints. Strung together degrees of freedom in translation may be produced within the joints or by installing the joints in such a way that they can move. Panes can be mounted in a statically determinate manner by virtue of an appropriate combination of degrees of freedom.

10 Claims, 5 Drawing Sheets

Fig. 4a
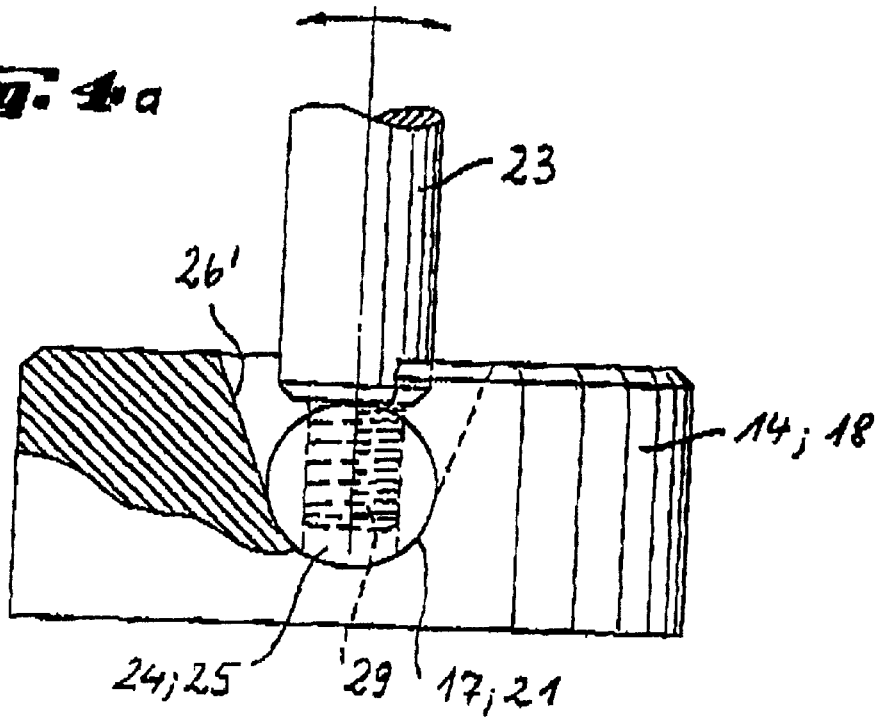
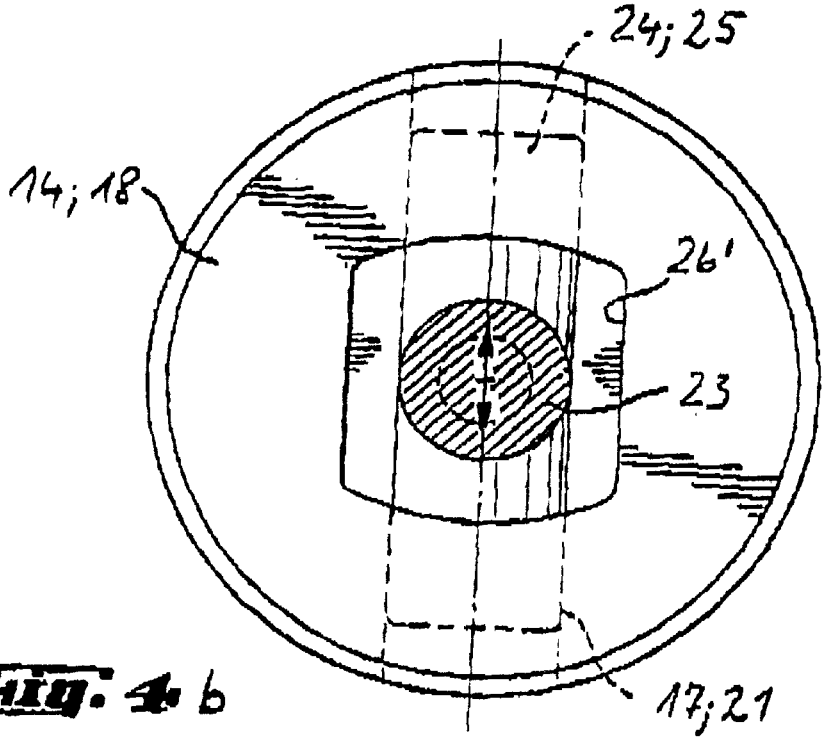
Fig. 4b 1
31
35
23
33
22
24
32
34
14'
30

DEVICE FOR FIXING PLATES, IN PARTICULAR GLASS PLATES

BACKGROUND OF THE INVENTION

1. Field of the Invention

The present invention relates to an attachment device for panes, particularly panes of glass, comprising retainers arranged between each pane of glass and a support structure with a view to transferring the loads from panes to the support structure, which retainers comprise means for compensating for the dimensional variations or differences, deformations and displacements between the pane and the support structure.

2. Discussion of the Background

In the glass-construction industry, there are, in general, many known elements for retaining or attaching at isolated points which support glazing, for example in a facade cladding, only over a small area. They make it possible to produce largely transparent constructions requiring little in the way of optical materials.

There are in existence systems which support glazing in pairs at its edge and which pass through the joins between panes. Other retainers pass through holes made in the glazing.

Various loadings assume importance in glass constructions for reasons of safety. On the one hand, there are the external loadings (the weight of the glass itself, wind, precipitation, shocks, etc.). On the other hand, there are stresses exerted by constraints (impeded or prevented deformations, or compensation movements, resulting from temperature variations, tolerances in the support structure and fitting errors, for example). It is known that glass is extremely fragile and, unlike ductile materials (metals or plastics for example) can tolerate only extremely small amounts of elastic deformation and no plastic deformation at all.

In theory, the glass therefore must experience minimum mechanical stressing when loads exerted on it are transferred to the support structure of framework.

The matter of determining which of the effects described themselves produce stresses in the glass depends on the static system, that is to say, in particular, on the way in which the panes of glass are mounted.

Unfavourable static systems demand greater thicknesses of glass with a higher self-weight and therefore a stronger support structure. If the mounting is statically indeterminate then the panes will experience stresses both from the external loading and from pressures. By contrast, if the panes are mounted in a statically determinate manner, only the external loadings will be exerted, whereas the pressure loadings will be compensated for in the system or will even not occur. The tensions in the glass resulting from the external loadings are also lower when the mounting is statically determinate than when the panes are more firmly attached.

Known retaining systems using isolated points already make it possible to fulfill these requirements satisfactorily. Spherical or ball joints permit torsion between the glass and the support structure. However, the isolated point supports with spherical joints do not yet in themselves constitute a truly statically determinate manner of mounting a pane of glass. This result can be achieved only by means of additional freedoms in translation.

There are also in existence retainers at isolated points with spherical and sliding joints. In a retainer disclosed by document DE-44 00 979 C2, a lower spherical bushing is attached to the support structure. Its normal axis is perpendicular to the surface of the pane of glass that is to be attached. A compensation piece is placed on this spherical bushing so that it can pivot like a sphere, but without there being any degree of freedom in translation with respect to the normal axis. A support piece is held on the compensation piece in such a way that it can move perpendicularly to the said normal axis, that is to say parallel to the pane of glass that is to be attached, in all directions within a limited field. However, its adjustable and almost clearance-free axial guidance allows pivoting movements only with interaction with the compensation piece. On the support piece, the pane of glass is clamped onto a thin elastic insert using a screw which passes through a hole in the surface of the glass.

Document DE-43 40 511 A1 describes a stress-free attachment device for panes of glass, in which device each retainer comprises a universal joint on the pane side, in some embodiments with a free bearing, a hinge joint arranged spatially some distances from the universal joint is provided on the support structure side. It may be replaced by a slideway for compensating for tension by sliding, the practical configuration of which slideway is not, however, described in greater depth.

Document DE-44 45 724 A1 describes an attachment device for panes, the retainers of which have a universal joint essentially on one side. Some axial direction from this joint, depending on the embodiment, there may be another spherical joint or hinge joint. The particular features relating to compensation for stresses by translation or sliding are not disclosed.

SUMMARY OF THE INVENTION

The invention now intends to produce an attachment device of the type described in the introduction, advantageously without a universal joint, in which, degrees of freedom in rotation in compensation means of the retainers are embodied solely by uni-axis pivoting joints.

According to these advantageous developments, the retainers further comprise compensation means with degrees of freedom in translation so as to allow relative displacements, at least over limited distances, between the pane and the support structure, these displacements being due, for example, to thermal expansion.

According to one development of the invention, uni-axis hinge joints may be produced in a particularly simple way so as to allow sliding which in itself is restricted in the direction of the axis of the hinge. Such an embodiment, if need be, then allows the pivoting and sliding movements to be transferred locally or strung together. Hinge joints can be produced in the form of bushes and pins or from pairing two cylindrical surfaces, one convex and one concave, with one another for sliding, there being appropriate safeguards against lifting included.

A retainer in the form of a free bearing preferably comprises two hinge pins which extend at right angles to each other in projection. In this instance they may form an intersection or may lie some distance from one another.

It is also possible to separate the two degrees of freedom—"pivoting" and "sliding"—in the spatial and functional plane, for example by arranging the base of one hinge on a support so that it can be displaced flat or along an axis on a support.

In another advantageous embodiment, a retainer may also have a degree of freedom in rotation with respect to its longitudinal axis intersecting the pane.

BRIEF DESCRIPTION OF THE DRAWINGS

Other features and advantages of the invention emerge from the drawings of the embodiments and from their detailed description hereafter.

In the drawings:

FIGS. 4*a* and 4*b* show two views, at 90° from each other, of an alternative form of a component of the retainer.

DETAILED DESCRIPTION OF THE PREFERRED EMBODIMENTS

Figure 1:
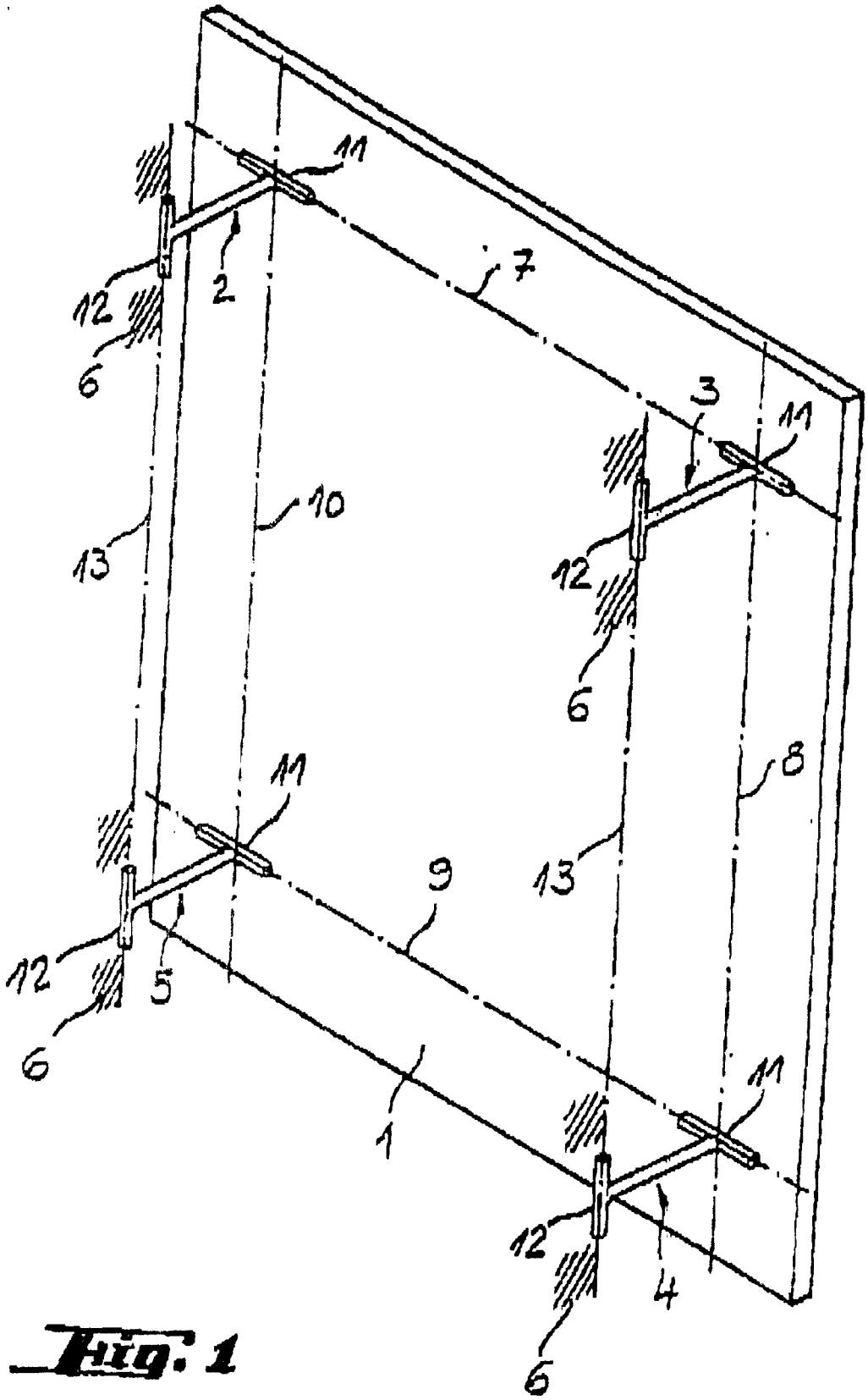
FIG. 1 shows a simplified perspective skeleton diagram of an attachment device for a pane, arranged at each of the four corners of which there is a retainer according to the invention.

According to FIG. 1, a rectangular pane 1, particularly a pane of glass, is fitted with four retainers 2, 3, 4 and 5 which are illustrated only diagrammatically. The pane is, for example, suspended vertically from the facade of a building. The figure shows the rear of the pane from the support structure, indicated by the reference 6. The retainers 2 to 5 extend between the support structure 6 and the pane 1. Their longitudinal axes extend essentially at right angles to the plane of the pane.

Four axes 7, 8, 9 and 10 depicted in chain line extend some distance from the four edges of the pane 1 and parallel to these edges. In the mounted position illustrated, the axes 7 and 9 extend horizontally and the axes 8 and 10 vertically, each being parallel to the adjacent edge of the pane. The points of intersection of the four axes 7 to 10 defines the position of each of the retainers 2 to 5, the longitudinal axis of each retainer intersecting one of the said points of intersection. The symmetrical layout illustrated here of the retainers on the surface of the pane is not, however, absolutely essential, and panes of absolutely any shape may of course be attached in this way.

Essentially, each retainer 2 to 5 is connected to the pane 1 by a hinge joint 11. The axis of pivoting of the hinge joints 11 extend horizontally in the direction of the axes 7 and 9. On the support structure side, the retainers 2 to 5 are generally also fitted with hinge joints 12. The axes 13 of pivoting of these hinge joints extend at right angles to the axes of the hinge joints 11. They therefore extend parallel to the axes 8 and 10, that is to say parallel to the line of action of the static weight.

In theory, it would be possible to switch the orientation of the hinge joints so that the joints 11 allow movement about a vertical axis of pivoting and so that the joints 12 allow movement about a horizontal axis. In this way, the static weight of the pane 1 could, however, already produce a local bending force, which is something that can only occur in the case of the axis geometry illustrated if forces are exerted in the lateral horizontal direction.

In theory, each of the hinge joints 11 and 12 studied can not only rotate about its axis of pivoting and thus constitute a compensation means with a degree of freedom in rotation, but can also slide in the direction of the axis in a limited field. The skeleton diagram of FIG. 1 does not depict any limit on the degrees of freedom except for modifications purely in terms of translation of the distance between the pane 1 and the support structure. The intersecting axes of pivoting protect the pane 1 from any bending moment when normal forces are applied in all directions, and the longitudinal displacements are absorbed by sliding along the axes of pivoting. For each pane, there will, however, be a stationary point defined and this will determine the overall position of the pane on the support structure.

It should be strongly emphasized that the transverse offset between the axes of pivoting of the joints 11 and 12 is not essential. It is also possible to use so-called intersecting joints in which the two hinge axes intersect one another, so long as they allow at least partial relative displacements.

Some embodiments of the hinge joints will be described hereafter. In this respect, various possibilities are also described for reducing the degrees of freedom, something which is essential for transferring the stresses from the pane 1 to the support structure 6 in a statically determinate way.

Figure 2:
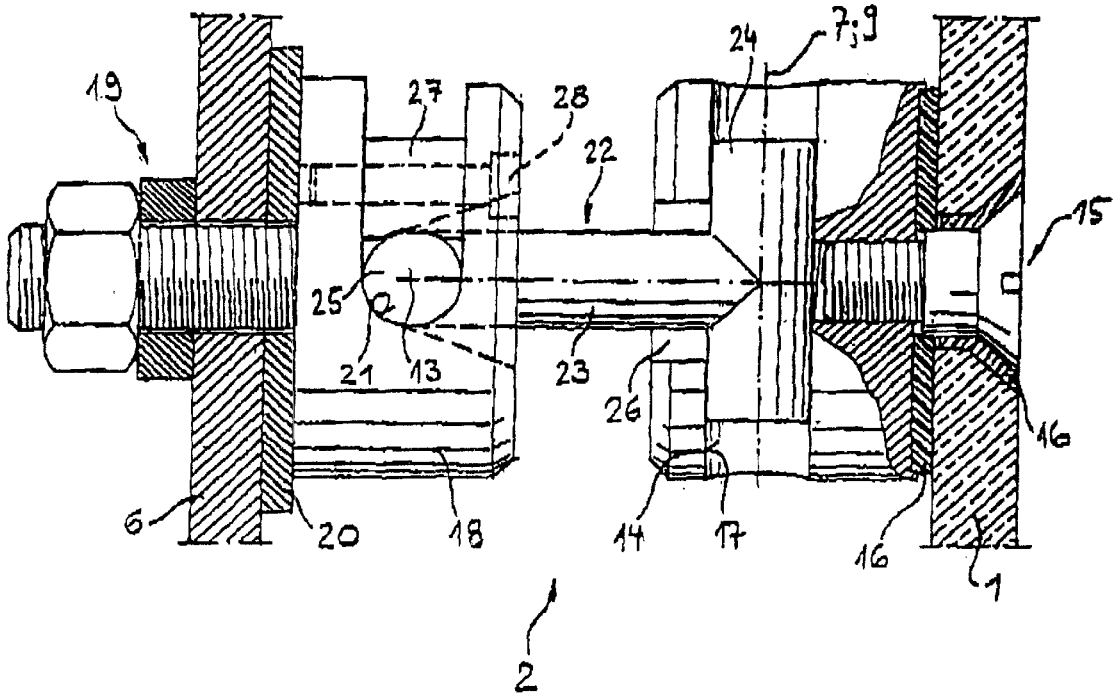
FIG. 2 is a view of all the essential components of a retainer of the attachment device in the bottom of FIG. 1.

As shown in FIG. 2, a retainer 2 extends between the suspended pane 1, on the right, and the support structure 6, shown on the left. A support piece 14 is connected to the plane 1 by a screw 15 which passes through a hole in the pane 1. According to the customary technique, elastic inserts 16 are arranged between the pane 1 and the support piece 14 or the screw 15. The support piece 14 forms a pivot bearing 17, the axis of which extends parallel to/along one of the horizontal axes 7 or 9 shown in FIG. 1, and which is produced in the form of a cylindrically rounded bottom of an open slot on one side.

An anchoring piece 18 is attached to the support structure 6 by a screw 19 with the insertion of an adapter washer 20. The anchoring piece 18 also forms a pivot bearing 21, the axis of which corresponds to one of the vertical axes 13 mentioned in FIG. 1.

The support piece 14 and the anchoring piece 18 can be produced simply in the form of round discs in which the necessary recesses are made.

A connecting piece 22 connects the two pivot bearings 17 and 21. It comprises a connecting bar 23 which is along the longitudinal axis of the retainer 2. Its length essentially determines the spacing between the pane 1 and the support structure 6. There are cylindrical hinge pins 24, 25 at the two ends of the connecting bar 23. Their longitudinal axes extend, a certain distance from one another, at right angles to one another. Overall, the connecting piece 22 therefore is the shape of a double T, the two transverse arms (the hinge pins 24 and 25) of which are orientated at 90° to one another with respect to the longitudinal axis of the upright of the T (the connecting bar 23) but lie in mutually parallel planes. This piece may be manufactured from simple part-worked products, for example round steel bar stock of sufficient thickness, or may be cast in a die, of course, use may also be made of high strength plastics.

The hinge pin 24 is in the pivot bearing 17. Therein, it can pivot in both directions, at least to a certain extent. These two components form one of the hinge joints 11 of horizontal pivot axis, sketched out in FIG. 1.

The hinge pin 25, for its part, can pivot inside the pivot bearing 21 and therewith forms one of the hinge joints 12 of vertical axis 13 of pivoting which are illustrated in FIG. 1.

It can also be seen in FIG. 2 that the pivot bearing 17 comprises a recess 26 which is transverse to its axis of pivoting, and which the connecting bar 23 enters with clearance in all directions. What this means is that the hinge pins 24 can both pivot and slide in the longitudinal direction inside the pivot bearing 17 and can do so in both directions starting from the central position illustrated, until the connecting bar 23 comes laterally up against one of the walls of the recess 26.

The pivot bearing 21 arranged facing the pivot bearing 17 with an 90° offset, is produced in the same way. The recess 26 cannot be seen in the view illustrated.

Friction between the hinge pins and the pivot bearings must naturally remain as low as possible. This result can be achieved by high-level surface treatment of these components, by appropriate combinations of materials and/or by lubrication. For example, the anchoring piece and the support piece may be made of a metal sinter endowed with good sliding properties. Depending on the anticipating loadings, use may also be made of pieces made of high strength plastics.

The connecting bar 23, and therefore the distance or transverse separation between the hinge pines 24 and 25 must be as short as possible so that the longitudinal displacements by sliding are not unnecessarily impeded by jamming movements.

When assembling the hinge joints 11 and 12, the hinge pins 24 and 25 may simply be inserted transversely into their pivot bearings which are open on a respective side, until they reach the ends of these bearings. At the same time, the connecting bar 23 passes through the respective recess 26 which is transverse with respect to its longitudinal axis.

This embodiment in which the pivot bearings are open on one side is particularly suited to connecting pieces which are prefabricated as one or more parts.

A safety piece 27 is fixed into the anchoring piece 18 illustrated in FIG. 2. This safety piece is preferably attached removably by means of a screw 28 and closes the open side of the pivot bearing 21. It assures the hinge pins 25 in the manner of a bearing cap in the pivot bearing 21. It should be remembered at this point that this bearing is open on one side in a horizontal direction in the preferred mode of mounting.

On the side of the pane 1 where the pivot bearing 17 is open on one side vertically downwards in the preferred mode of mounting, it is not essential to provide a safety piece of this kind. It may also be enough to suspend the pane, according to FIG. 1, from the four prepared retainers 2 to 5 because its weight keeps it safely in the end of the pivot bearing 17.

When attaching the pane to the support structure, it is possible, for example, to follow the following procedure: first of all, the anchoring pieces 18 are attached to the support structure 6 in such a way that the openings of the pivot bearings 21 face the side and so that their axes extend vertically. The openings of the pivot bearings that are situated at the same height will preferably be orientatated so that they face each other. Next, the hinge pins 25 are installed and, if need be, fixed by means of the safety pieces 27. In the case of the embodiment depicted in FIG. 1, four connecting bars 23 then extend horizontally from the anchoring pieces 18. At their free ends, four hinge pins 24 are orientatated uniformly with their axes horizontal. The support pieces 14 previously attached to the pane can then simply be suspended in these until all the hinge pins 24 rest on the end of the pivot bearing 17. The pane 1 can now be removed only by lifting it.

In a diagram in perspective, FIG. 3 once again illustrates the overall configuration of a retainer with hinge joints 11 and 12. The direction of view is the same as in FIG. 1. For reasons of simplicity, the screws on the support piece 14 and on the anchoring piece 18 have been omitted. The broadly similar embodiment of the latter two components, and the configuration of the recesses 26 provided, are illustrated here. In particular, the radial mobility in all directions of the connecting bar 23 in the recess 26 of the support piece 14 can be seen. The hinge pins 24 can pivot in the pivot bearing 17 in one direction and in the other and can slide both sides.

FIGS. 4*a* and 4*b* depict, in two views, one from the side (4*a*) and the other from above (4*b*), an alternative form of a support piece 14 or of an anchoring piece 18. The pivot bearing 17/21 has the form of a cylindrical through hole. In place of the recess 26 there is an oblong hole 26'. In a free bearing, this again is aimed at allowing the connecting bar 23, radial mobility in all directions. In the direction of its longitudinal axis, this bar must in general have the smallest possible amount of clearance so as to assemble the pane and the support structure rigidly in terms of tension and compression. The alternative form depicted in FIGS. 4*a* and 4*b* is suitable only for connecting pieces to be assembled from several parts. The hinge pins 24/25 must first of all be introduced into the said through hole. Next, the connecting bar 23 is inserted into the oblong hole 26'. Using an appropriate screw 29, merely sketched in the side view, this bar is connected to the hinge pins. If the two ends of the connecting bar have screw threads of opposite hand, this bar can be screwed into the two hinge pins (in the support piece and in the anchoring piece) simultaneously while the retainer is still laterally accessible.

If necessary, it is also possible to combine the two illustrated embodiments of the pivot bearings, that is to say to produce, at one end of the connecting bar, fixed hinge pins as in FIG. 2 and, at the other end, an assembly screw of the type described earlier.

If the lateral displacement of hinge pins in the pivot bearing is to be subordinate to determining the corresponding degree of freedom, then a number of possibilities present themselves. The recess 26 or the oblong hole 26' which corresponds to it in the direction of the hinge axis can simply be made with a width that merely corresponds to the thickness of the connecting bar so that this connecting bar fixes the associated hinge pins in the longitudinal direction.

Another possibility consists in providing blocking which acts on the end faces of the pins. To this end, screws may, for example, be screwed right into the pivot bearings or into the through holes, the end faces of the pins coming up against the end faces or points of the screws.

Likewise, it is also possible, if necessary, to prevent the pin from rotating in the pivot bearing by clamping, by additional attachment pieces or by adopting suitable dimensions for the recess 26 or the oblong hole 26' which corresponds to it.

If, for example, there is a desire to produce a fixed point, it is possible, as described earlier, on the one hand, to produce the recess 26 without transverse clearance depending on the dimensions of the diameter of the connecting bar and, on the other hand, to close off its open side after it has been introduced by fitting a safety piece similar to the safety piece illustrated in FIG. 2.

By comparison with a direct fixed connection between the connecting piece 22 and the support piece 14 and/or the anchoring piece 18, these measures have the advantage that the components broadly speaking comply with the standards, even at the fixed point.

Another embodiment, not depicted, consists in inverting the method of mounting the hinge joints already described, in a way which is kinetically equivalent. At the location of a pivot bearing formed on the support piece and/or the anchoring piece are two pins extending, while projecting, along the same axis in a radial direction. An appropriate connecting piece comprises, at its end, a forked bearing housing the support piece or the anchoring piece, and the two branches of which are mounted, with pivoting, on the said pin and can be displaced in the longitudinal direction to a certain extent if necessary.

In another conceivable alternative embodiment, the hinge pin (which is vertical in the mounted position) is displaced towards the sides of the support structure in the connecting piece. This yields an additional reduction in the separation between the two uni-axis joints.

Figure 5:
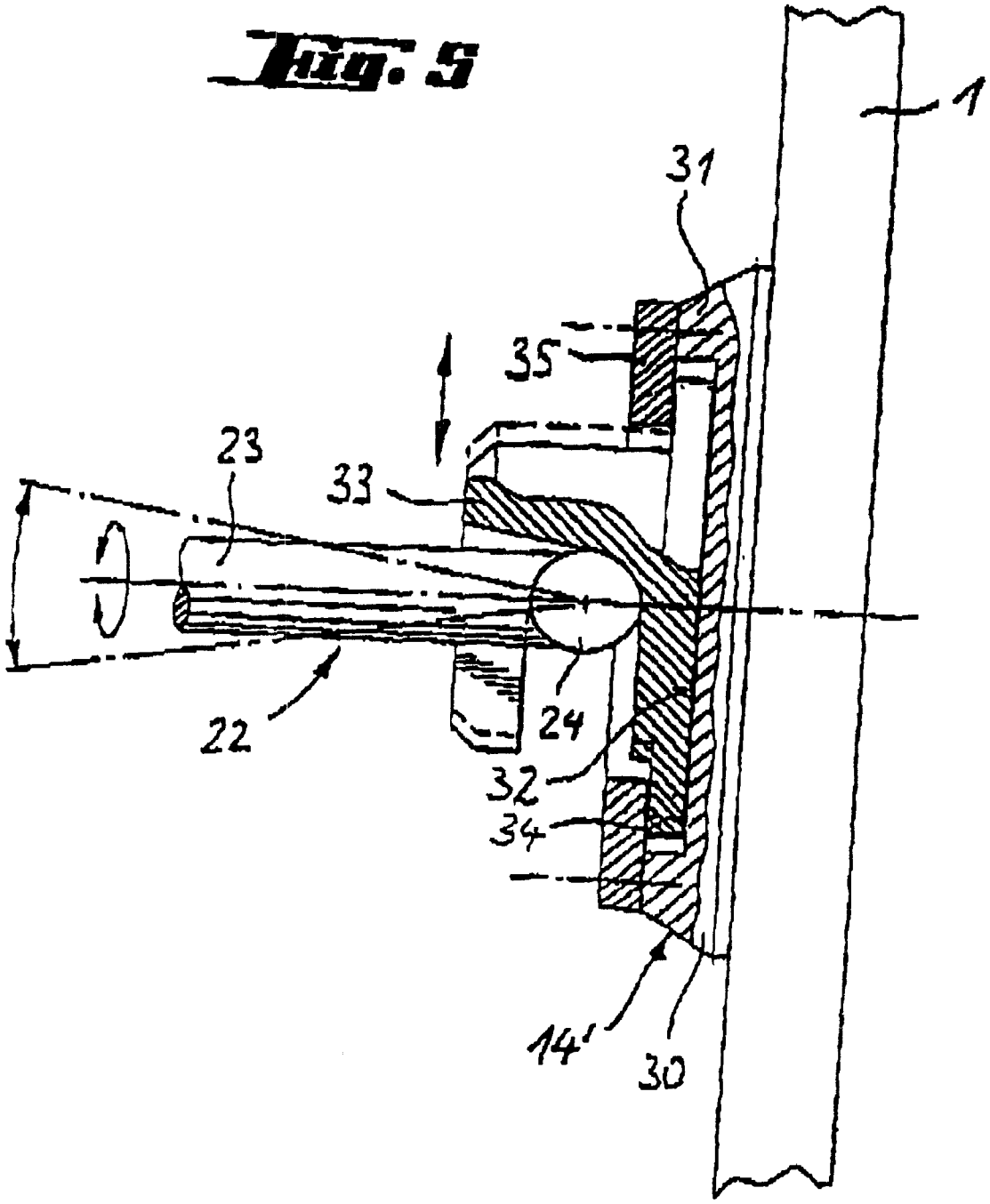
FIG. 5 illustrates a modified support piece of a retainer so as to clarify an alternative way in which the degrees of freedom in translation and in rotation can be strung together.

FIG. 5 partially depicts another alternative form of a retainer, which constitutes another possibility for stringing together one or two degrees of freedom in uni-axis rotation with one or two degrees of freedom in translation.

This embodiment is described with a modified support piece 14' which is made of several parts with a support cup 30 comprising an edge 31 and a sliding surface 32 surrounded by this edge, and a pivot bearing 33 which can be displaced over this surface and comprises a projecting collar 34.

The support cup 30 is fixed to a plane 1 in a way which is not depicted in greater detail. A cover disc 35, which is preferably removable, is attached to its edge 32. This disc overlaps the collar 34 and protects the pivot bearing 33 from lifting off the sliding surface 32. In a way similar to the embodiments described earlier, a connecting piece 22 pivoting about an axis, and which therefore has a degree of freedom in rotation, is arranged in the pivot bearing 33.

The pivot bearing 33 can move away from the central position depicted in hatching until its collar 34 bears against the edge 31. One or two degrees of freedom in translation may be allowed in the sliding surface. The dimensions of the collar and of the edge, or of the sliding surface may be mutually determined to create a limitation. If necessary, the collar may thus be produced in such a way that it can move only in one direction in a straight line in one direction and in the other by virtue of the edge which loosely traps the two sides.

Figure 3:
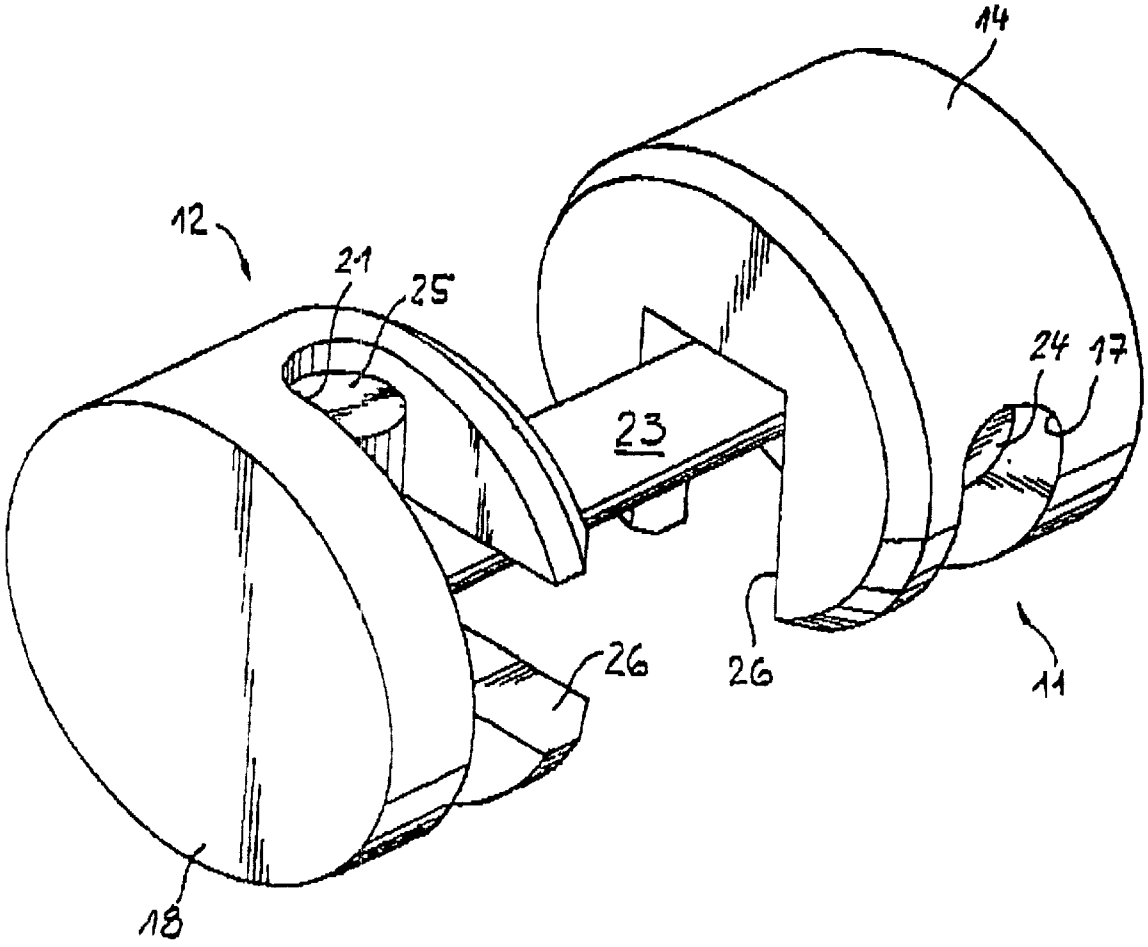
FIG. 3 is a diagram in perspective of a retainer.

If the sliding surface 32 and its counterpart sliding surface of the pivot bearing are produced with a cylindrical curvature and the pivot bearing can be moved only in the direction of the axis of the cylinder, then a degree of freedom in translation and a degree of freedom in rotation can also be combined in the same way as in the embodiments illustrated in FIGS. 2 to 4. The connecting piece 22 can then be attached to the pivot bearing 33.

Depending on the configurations of the edge and of the collar, the body of the pivot bearing 33 on the sliding surface 32 may also rotate on an axis about a normal to the sliding surface (plane) or about the longitudinal axis of the connecting piece 22, which means that an additional degree of freedom in rotation can thus be permitted or prevented.

Incidentally, this degree of freedom in rotation can also be provided, if need be, actually within the connecting piece, because this piece resists tension and compression but has properties allowing torsion.

What is claimed is:

1. An assembly comprising:

a support structure;

a glass pane; and a plurality of load transfer retainers arranged between said glass pane and said support structure, wherein each of said retainers comprises two uni-axis pivoting joints having axes transverse to one another.

2. The assembly of claim 1, wherein each of said uni-axis pivoting joints further permit translational movement between said support structure and said glass pane.

3. The assembly of claim 2, wherein each of said uni-axis pivoting joints permits translational movement along the axis thereof.

4. The assembly of claim 2, wherein each of said uni-axis pivoting joints comprises a pivot bearing and a hinge pin pivotally mounted in said pivot bearing, wherein said hinge pin is movable in said pivot bearing along the axis of the hinge pin.

5. The assembly of claim 1, wherein each of said two uni-axis pivoting joints of a respective one of said retainers comprises a part forming a pivot bearing and being attached to a respective one of said support structure and said glass pane.

6. The assembly of claim 5, wherein each of said retainers further comprises a connecting bar having a hinge pin at each end thereof, each of said hinge pins being pivotally mounted in one of said uni-axis pivoting joints.

7. The assembly of claim 5, wherein each of said retainers further comprises a connecting bar having a hinge pin at each end thereof.

8. The assembly of claim 6, wherein each of said pivot bearings comprises a rounded cylindrical end of a slot in a respective one of said parts, said slot having an open side, and a recess extending transverse to the pivot axis of said pivot bearing and accommodating said connecting bar.

9. The assembly of claim 8, wherein the connecting bar has a radial clearance in all directions inside said recess.

10. An attachment device for a glass pane, the attachment device comprising a plurality of load transfer retainers adapted to be arranged between said glass pane and a support structure, wherein each of said retainers comprises two uni-axis pivoting joints.

wherein each of said two uni-axis pivoting joints comprise a part forming a pivot bearing, and a connecting bar having a hinge pin at each end thereof, and wherein each of said pivot bearings comprises a rounded cylindrical end of a slot in a respective one of said parts, said slot being adapted to receive one of said hinge pins and having an open side, and a recess extending transverse to the pivot axis of said pivoting bearing and adapted to accommodate said connecting bar.

* * * * *